US007623821B2

(12) United States Patent
Kubota et al.

(10) Patent No.: US 7,623,821 B2
(45) Date of Patent: Nov. 24, 2009

(54) CONVEYOR DEVICE, PROCESS CARTRIDGE, IMAGE FORMING APPARATUS, AND METHOD OF FORMING IMAGE

(75) Inventors: Tomohiro Kubota, Osaka (JP); Yoshiyuki Shimizu, Osaka (JP); Kenzo Tatsumi, Osaka (JP); Yoshihiro Kawakami, Hyogo (JP); Tomofumi Yoshida, Ibaraki (JP); Hirobumi Ooyoshi, Ibaraki (JP); Koji Kato, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 249 days.

(21) Appl. No.: 11/738,035

(22) Filed: Apr. 20, 2007

(65) Prior Publication Data

US 2007/0248390 A1 Oct. 25, 2007

(30) Foreign Application Priority Data

Apr. 24, 2006 (JP) ..... 2006-118635
Jul. 6, 2006 (JP) ..... 2006-186243
Mar. 7, 2007 (JP) ..... 2007-057540

(51) Int. Cl.
*G03G 21/00* (2006.01)
*G03G 15/08* (2006.01)

(52) U.S. Cl. ..... 399/358; 198/804; 399/111

(58) Field of Classification Search ..... 399/358, 399/359, 360; 198/804, 832
See application file for complete search history.

(56) References Cited

U.S. PATENT DOCUMENTS 5,349,427 A * 9/1994 Benedict et al. ..... 399/360
5,956,556 A 9/1999 Nakajima et al. ..... 399/359
6,999,702 B2 * 2/2006 Fordahl et al. ..... 399/360 X
7,049,037 B2 * 5/2006 Katoh et al. ..... 399/358 X
7,424,263 B2 * 9/2008 Shimizu et al. ..... 399/358
2006/0078361 A1 * 4/2006 Park ..... 399/359
2006/0181011 A1 * 8/2006 Wolf ..... 271/264
2008/0145108 A1 6/2008 Yoshida et al.
2008/0145119 A1 6/2008 Tatsumi et al.
2008/0170898 A1 7/2008 Shimizu et al.
2008/0187358 A1 8/2008 Kubota et al.
2008/0219698 A1 9/2008 Shimizu et al.
2008/0279581 A1 11/2008 Shimizu
2008/0279586 A1 11/2008 Tatsumi et al.

(Continued)

FOREIGN PATENT DOCUMENTS

CN 2714480 Y 8/2005

(Continued)

OTHER PUBLICATIONS

Machine translation of JP 08-115032 A dated Feb. 12, 2009.*

(Continued)

*Primary Examiner*—Sophia S Chen
(74) *Attorney, Agent, or Firm*—Oblon, Spivak, McClelland, Maier & Neustadt, L.L.P.

(57) ABSTRACT

A conveyor device includes a conveyor belt and a driving unit that applies a driving force to the conveyor belt at different portions in a width direction of the conveyor belt to drive the conveyor belt. The driving unit includes a driving shaft having a projection corresponding to each of the portions. The belt includes a recess corresponding to the projection arranged on each side of the conveyor belt in the width direction.

14 Claims, 5 Drawing Sheets

U.S. PATENT DOCUMENTS

| | | | |
|---|---|---|---|
| 2009/0022531 | A1 | 1/2009 | Kubota et al. |

FOREIGN PATENT DOCUMENTS

| | | | | |
|---|---|---|---|---|
| JP | 6-118846 | | | 4/1994 |
| JP | 8-6372 | | | 1/1996 |
| JP | 08-115032 | A | * | 5/1996 |
| JP | 8-339112 | | | 12/1996 |
| JP | 9-90845 | | | 4/1997 |
| JP | 2000-98842 | | | 4/2000 |
| JP | 3244972 | B2 | | 10/2001 |
| JP | 3281595 | B2 | | 2/2002 |
| JP | 3327380 | B2 | | 7/2002 |

OTHER PUBLICATIONS

U.S. Appl. No. 12/257,547, filed Oct. 24, 2008, Kubota, et al.

* cited by examiner

CONVEYOR DEVICE, PROCESS CARTRIDGE, IMAGE FORMING APPARATUS, AND METHOD OF FORMING IMAGE

CROSS-REFERENCE TO RELATED APPLICATIONS

The present document incorporates by reference the entire contents of Japanese priority documents, 2006-118635 filed in Japan on Apr. 24, 2006, 2006-186243 filed in Japan on Jul. 6, 2006, and 2007-057540 filed in Japan on Mar. 7, 2007.

BACKGROUND OF THE INVENTION

1. Field of the Invention

The present invention relates to a technology for conveying waste toner.

2. Description of the Related Art

In some electrophotographic systems for forming images, waste toner after a toner supplying process or an image forming process is conveyed by a conveyor belt. In one conventional technique, while a driving shaft is rotating, a projection provided at the driving shaft fits in one of holes arranged in a center line of the conveyor belt to apply a driving force to the conveyor belt. In another conventional technique, a pinion gear is meshed with the conveyor belt to apply a driving force to the conveyor belt. However, it frequently happens that the conveyor belt is inclined to one side due to poor fitting between the hole and the projection of the driving shaft, poor fitting of the pinion gear, and uneven tension of the conveyor belt, resulting in unstable running of the conveyor belt.

Japanese Patent No. 3281595 discloses an electrophotographic recording apparatus that includes a cleaning unit, a toner housing chamber, and a waste-toner conveyor belt. Waste toner that is removed from a photoconductor is conveyed to the toner housing chamber by the conveyor belt sliding and running along a groove. In the electrophotographic recording apparatus, the groove is used only for conveying the waste toner, and the conveyor belt cannot maintain the stable running due to the poor fitting of the driving shaft, the uneven tension of the conveyor belt, or the like.

Japanese Patent No. 3327380 discloses an image forming apparatus in which an inlet for waste toner is arranged higher than a lower cyclic axis of a conveyor belt, and a driving source is linked to the conveyor belt at an upper cyclic axis side to apply a driving force to the conveyor belt. Specifically, a pinion gear is meshed with the conveyor belt to apply the driving force to the conveyor belt. Accordingly, it frequently happens that the conveyor belt is inclined to one side due to the poor fitting of the pinion gear, and the uneven tension of the conveyor belt. As a result, the stable running of the conveyor belt cannot be maintained.

Japanese Patent No. 3244972 discloses a toner housing device in which a conveyor belt for conveying waste toner has long holes, and a driving roller for driving the conveyor belt has a projection that fits in one of the long holes to apply a driving force to the conveyor belt. That is, the projection of the driving roller fits in one of the holes arranged at the center of the conveyor belt such that the conveyor belt is driven with the rotation of the driving roller. Although a stress on the toner is mitigated, it frequently happens that the conveyor belt is inclined to one side due to the poor fitting between the hole of the conveyor belt and the projection of the driving roller, and the uneven tension of the conveyor belt. As a result, the stable running of the conveyor belt cannot be maintained.

Japanese Patent Application Laid-Open No. H8-6372 discloses a toner supplying unit that includes a conveyor belt mechanism including an endless conveyor belt that conveys toner with holding the toner therein, a flat toner hopper that houses the toner and has a toner supplying outlet at a toner supplying roller side, and a driving mortar that drives the conveyor belt mechanism. The conveyor belt has a plurality of holes from which the toner is supplied, and extends around pulleys. The pulleys at the toner supplying roller side support at least both sides of the conveyor belt. In the toner supplying unit, because a roller is meshed with one of the holes of the conveyor belt to drive the conveyor belt, it is difficult to remove the powdery material with which the hole is clogged. As a result, the stable running of the conveyor belt cannot be maintained. The holes and a space for conveying the powdery material can be separated by a separator such as a partition. However, such a structure increases the number of required members, which makes the toner supplying unit complicated. Moreover, when a fine powdery material such as a toner is used, the powdery material cannot perfectly separated by the partition. In other words, it is difficult to prevent the holes to be clogged.

SUMMARY OF THE INVENTION

It is an object of the present invention to at least partially solve the problems in the conventional technology.

According to an aspect of the present invention, a conveyor device includes a belt, and a driving unit that applies a driving force to the belt at least two different portions in a width direction of the belt to drive the belt.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
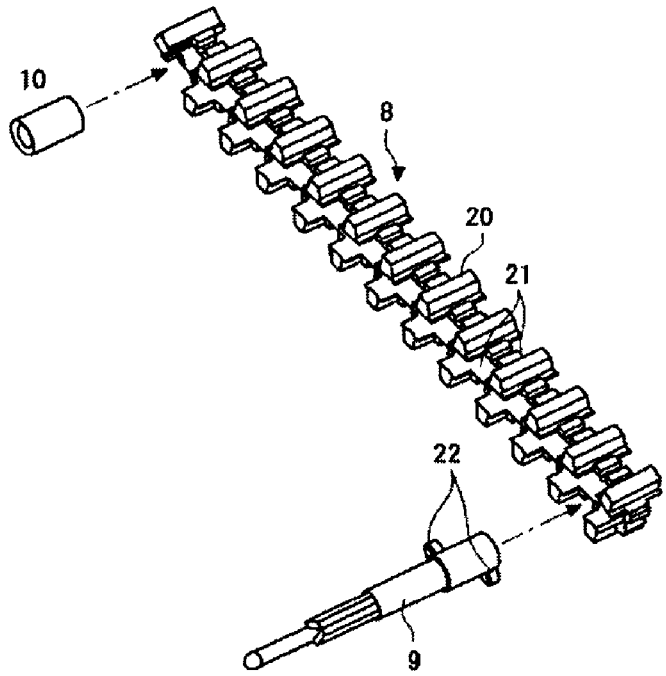
FIG. 1 is a perspective view of a conveyor device according to an embodiment of the present invention.

FIG. 1 is a perspective view of a conveyor device according to an embodiment of the present invention. A conveyor belt 8 that conveys a powdery material, such as toner, extends around a driving shaft 9 and a roller 10. Although the conveyor belt 8 in FIG. 1 is supported by two points, the conveyor belt 8 can be supported by three or more points. The conveyor belt 8 includes a plurality of partitions 20 that allows the conveyor belt 8 to effectively convey the powdery material and a plurality of recesses 21 arranged at both sides of the conveyor belt 8 to receive a driving force from the driving shaft 9. The driving shaft 9 has projections 22 each meshing with one of the recesses 21 to apply the driving force. In contrast to the conventional conveyor device in which the driving force is applied to the belt at only one portion, the driving force is applied to the conveyor belt 8 at a plurality of portions on different vertical axes against the conveying direction. Thus, it rarely happens that the conveyor belt 8 is inclined due to poor fitting between one of the projections 22 and a corresponding one of the recesses 21. This facilitates the stable running of the conveyor belt 8. The recesses 21 preferably penetrate through the conveyor belt 8.

The projections 22 are arranged at different positions in a width direction of the conveyor belt 8, opposed to each other across the rotation axis of the driving shaft 9. While the driving shaft 9 is rotating, the projections 22 alternately fit in a corresponding one of the recesses 21 at the different positions in the width direction of the conveyor belt 8. Thereby, when the conveyor belt 8 is inclined due to poor fitting between one of the projections 22 and the corresponding one of the recesses 21 at one side, the conveyor belt 8 returns to a balanced state at the next fitting that is made at the other side between the other one of the projections 22 and the corresponding one of the recesses 21.

Figure 2:
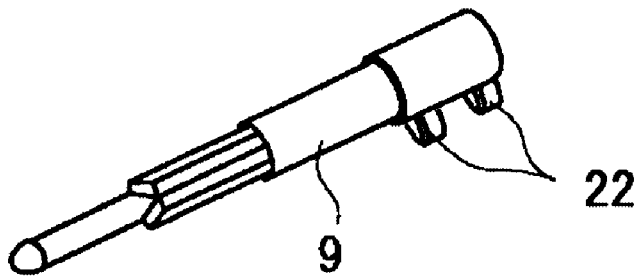
FIG. 2 is a perspective view of a modification of a driving shaft shown in FIG. 1.

FIG. 2 is a perspective view of a modification of the driving shaft 9. Unlike the projections 22 shown in FIG. 1, the projections 22 shown in FIG. 2 are arranged in a line parallel to the rotation axis of the driving shaft 9. While the driving shaft 9 is rotating, the pair of the projections 22 fit in the corresponding ones of the recesses 21, thereby holding the conveyor belt 8 from both sides, that is, the driving force is applied at two pints at the same time. This can reduce occurrence of inclination of the conveyor belt 8.

Figure 3:
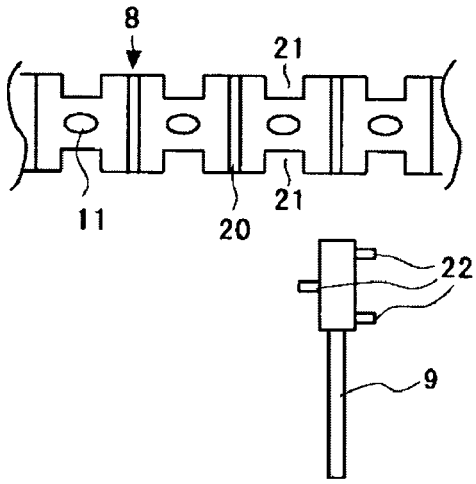
FIG. 3 is a schematic of a conveyor device according to another embodiment of the present invention.

According to the above embodiments, the driving force is applied to the conveyor belt 8 at the two different portions in the width of the conveyor belt 8. FIG. 3 is a side view of a conveyor device according to another embodiment of the present invention. Unlike the above embodiments, the conveyor belt 8 has a plurality of holes 11 in addition to the recesses 21 arranged at the both sides, and the driving shaft 9 has the projections 22 at three portions. Each of the projections 22 fits in the corresponding one of the recesses 21 or in a corresponding one of the holes 11 to apply the driving force to the conveyor belt 8. The holes 11 preferably penetrate through the conveyor belt 8.

The partitions 20 allow the conveyor belt 8 to effectively convey the powdery material without dropping the powdery material even when the conveying path of the conveyor belt 8 is at a steep angle. With a structure according to an embodiment of the present invention, it is possible to handle various conveying paths at angles raging from 0 degree to 90 degrees. Thus, the conveying path for the waste toner can be selected from a broader range of structural patterns.

Figure 4:
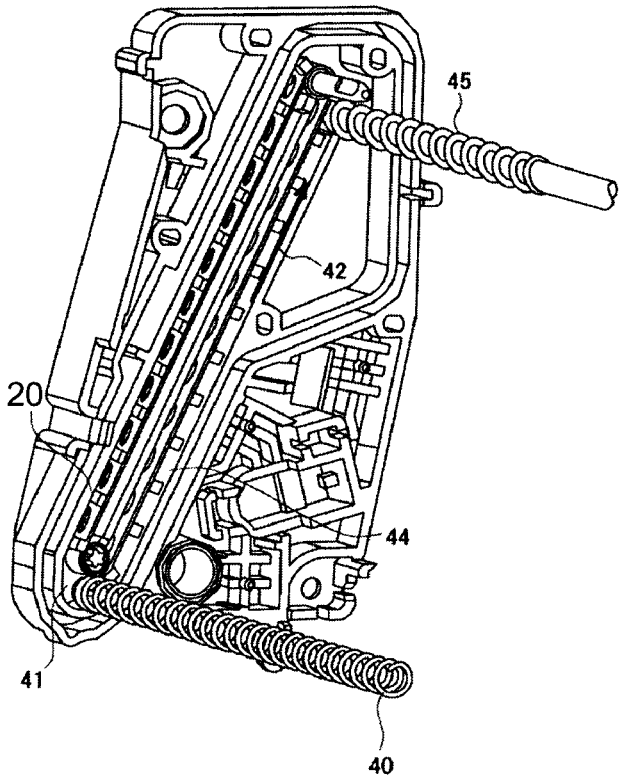
FIG. 4 is a perspective view of a waste-toner housing unit that houses waste toner from an image forming unit.

FIG. 4 is a perspective view of a waste-toner housing unit that houses waste toner from an image forming unit. Waste toner discharged from the image forming unit is conveyed to an upward conveyor unit 41 by a horizontal conveying screw 40. The waste toner is held in a space between the partitions 20 of the conveyor belt 8 moving in direction 42 and an outer wall 44 for a toner conveyor path, and is conveyed to a conveyor unit 45 that lifts up the waste toner to a waste-toner housing unit.

Figure 5:
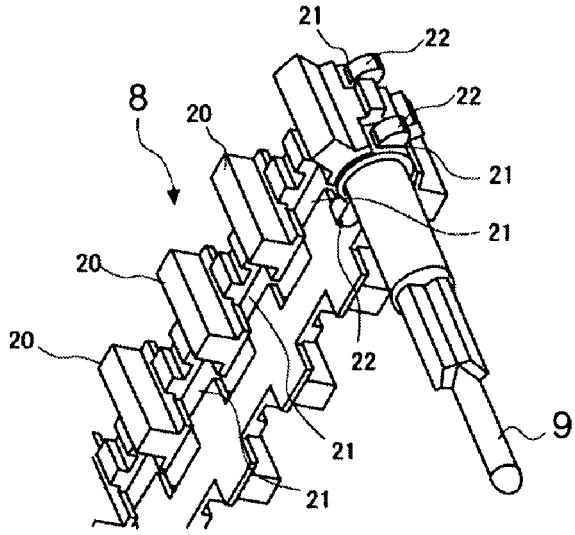
FIG. 5 is a perspective view of a conveyor belt for conveying waste toner shown in FIG. 4.

FIG. 5 is a perspective view of the conveyor belt 8 for conveying waste toner. The conveyor belt 8 has the recesses 21 on both sides. The projections 22 of the driving shaft 9 fit in the corresponding ones of the recesses 21 to drive the conveyor belt 8. Such a structure makes it possible to easily form the conveyor belt 8 by resin molding, which results in less cost. The conveyor belt 8 also has smaller projections between the partitions 20. This is because, by providing such smaller projections, it is possible to effectively mold an elastomer like the conveyor belt 8. Without the smaller projections, the endless portions of the conveyor belt 8 are formed thin, which disturbs the flow of polymer solutions, and hinders stable manufacturing.

Figure 6:
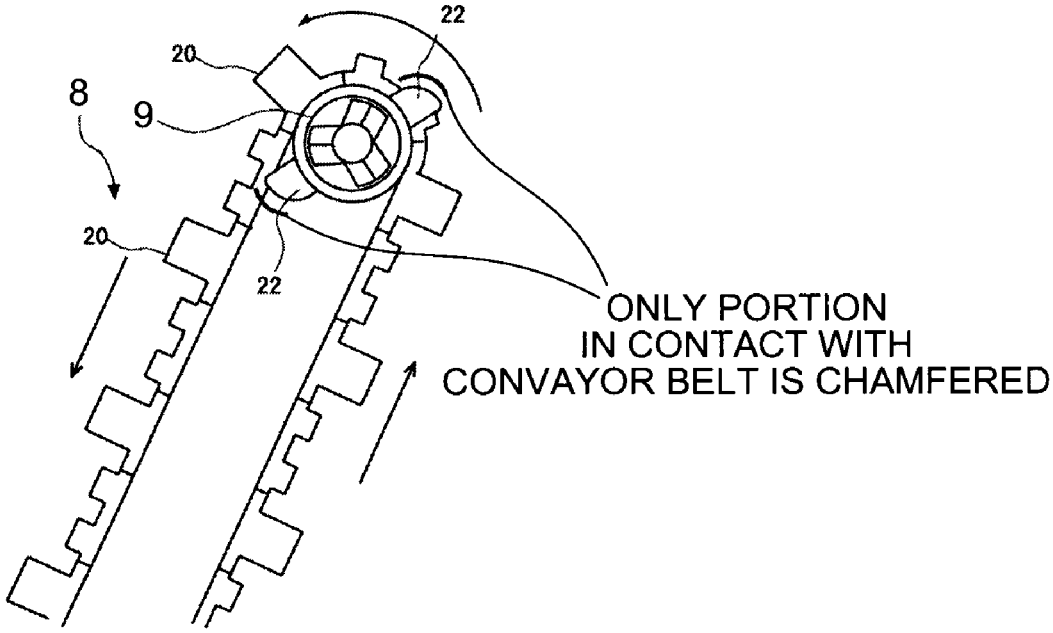
FIG. 6 is a side view of the conveyor belt and a driving shaft shown in FIG. 5.

FIG. 6 is a side view of the conveyor belt 8 and the driving shaft 9. The conveyor belt 8 is arranged between the projections 22 of the driving shaft 9, which makes it possible to prevent that the conveyor belt 8 is inclined. Moreover, the projections 22 have a round-chamfered portion, which makes it possible to prevent the conveyor belt 8 from getting wound around the driving shaft 9. The projections 22 are arranged at the both sides of the conveyor belt 8, sandwiching the conveyor belt 8 at the recesses 21. The projections 22 are arranged at the different two portions, opposed to each other across the rotation axis of the driving shaft 9. With such a structure, it is possible to rotate the conveyor belt stably at low cost.

Figure 7:
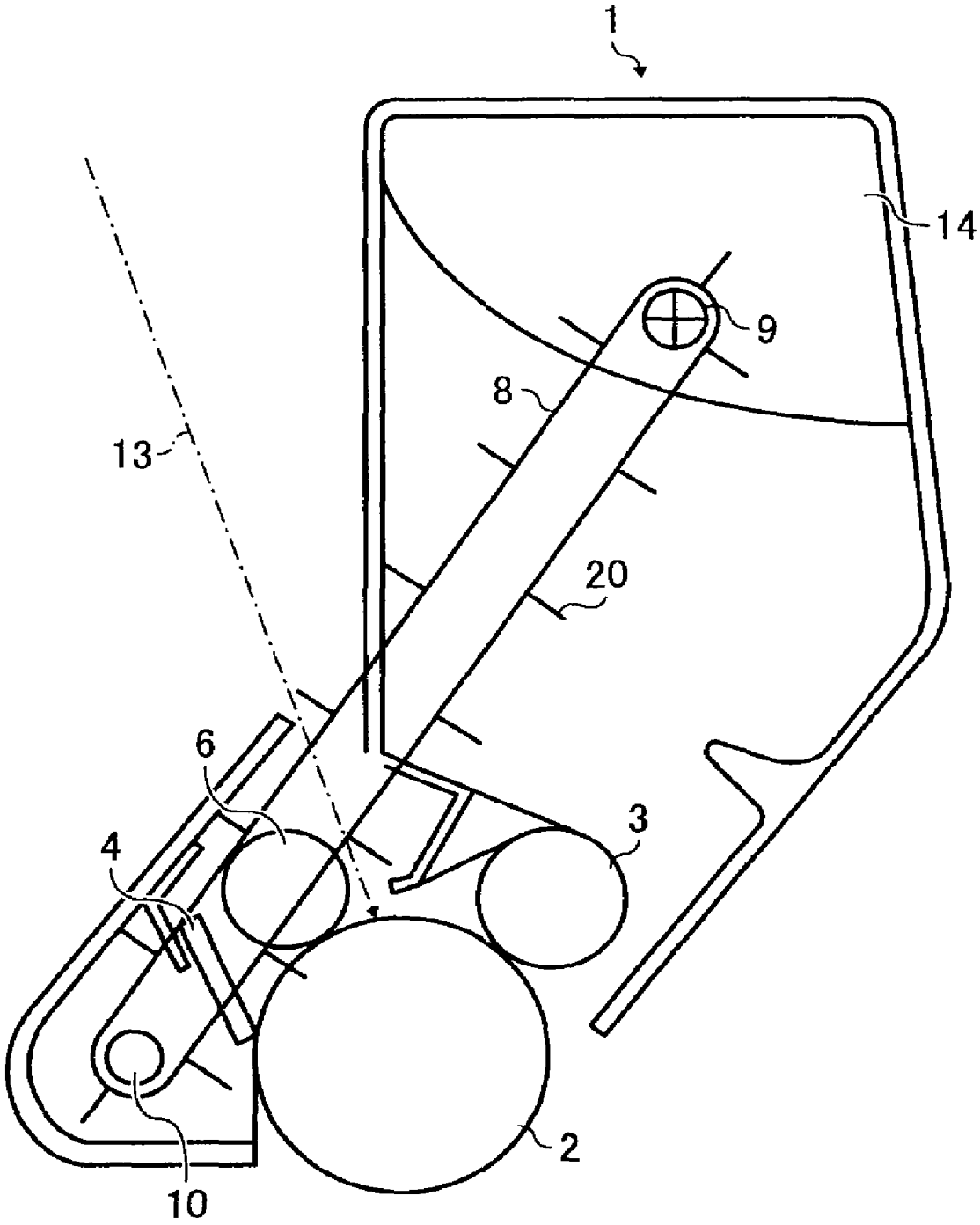
FIG. 7 is a side view of an example of a process cartridge including the conveyor device for conveying waste toner.

FIG. 7 is a side view of an example of a process cartridge 1 including the conveyor device for conveying waste toner described above. The process cartridge 1 includes a photoconductor 2, a developing unit 3, a cleaning blade 4, and a charging unit 6. After the charging unit 6 charges a surface of the photoconductor 2 to a predetermined potential, an exposing unit (not shown) exposes the surface of the photoconductor 2 so that a desired image is formed on the surface (a light penetrating path 13), and a latent image is formed on the surface of the photoconductor 2. When the photoconductor 2 rotates until a part of the surface on which the latent image is formed reaches the developing unit 3, a toner is attached to the latent image, and visible image is formed from the latent image. The visible image is transferred to an intermediate transfer unit (not shown). A residual toner not transferred to the intermediate transfer unit and remaining on the photoconductor 2 is removed from the photoconductor 2 by the cleaning blade 4. The conveyor belt 8 extends around the roller 10 and the driving shaft 9. The residual toner removed by the cleaning blade 4 is conveyed to a waste-toner housing unit 14, and is housed in the waste-toner housing unit 14. As described above, the waste toner can be stably conveyed.

Figure 8:
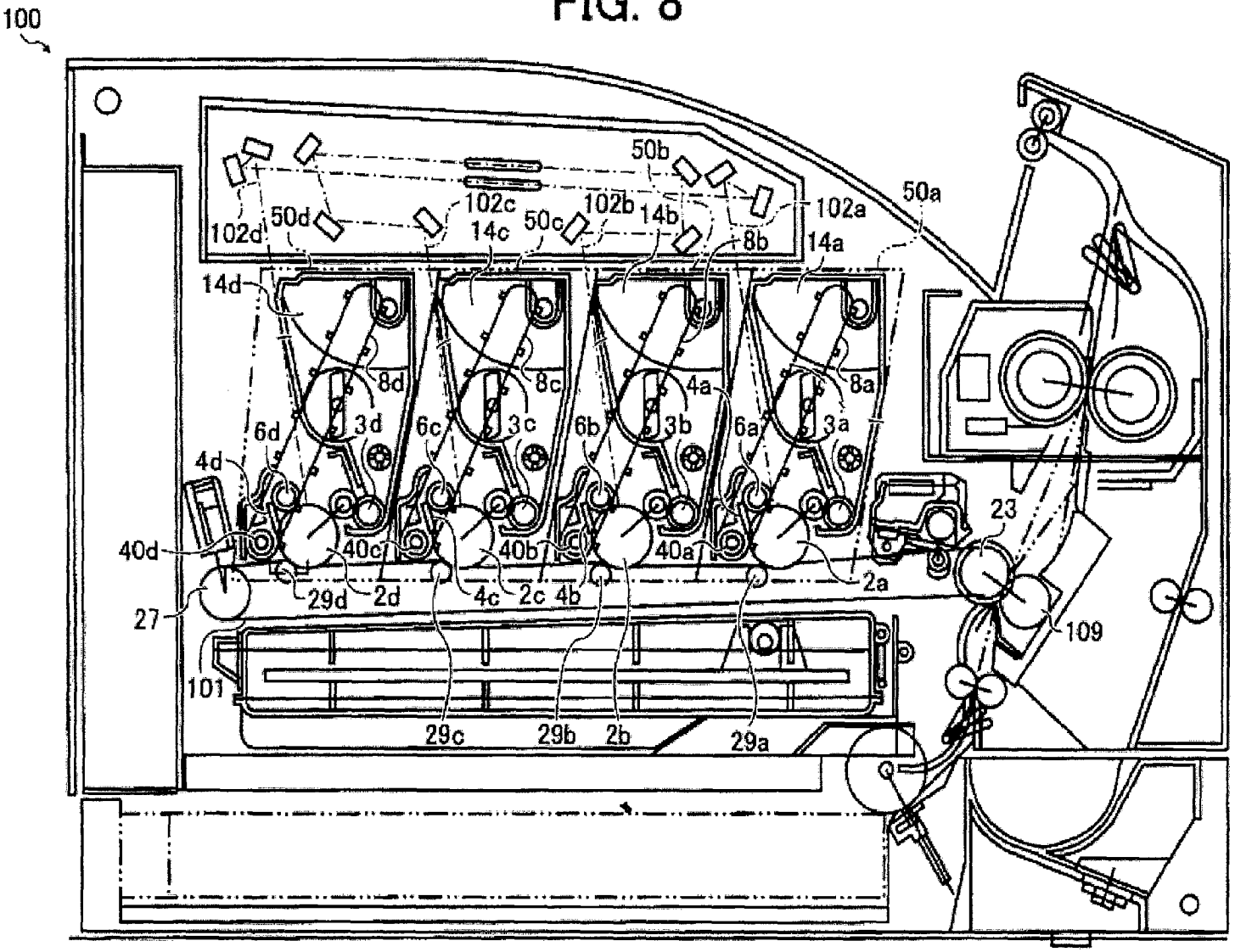
FIG. 8 is a side view of a full-color image forming apparatus including four image forming units each of which includes a photoconductor and a developing unit facing the photoconductor.

FIG. 8 is a side view of a full-color image forming apparatus 100 including four image forming units 50. Each of the four image forming units 50 includes the photoconductor 2 and the developing unit 3 that faces the photoconductor 2. In FIG. 8, the image forming unit 50 is attached to the image forming apparatus 100.

The image forming units 50 includes four developing units 3*a*, 3*b*, 3*c* and 3*d* (collectively, "the developing unit 3") each of which contains a different color toner as a developer, and photoconductors 2*a*, 2*b*, 2*c*, and 2*d* (collectively, "the photoconductor 2") that are arranged to be able to work with the developing units 3*a*, 3*b*, 3*c* and 3*d*, respectively. Surrounding the photoconductor 2 are cleaning blades 4*a*, 4*b*, 4*c*, and 4*d* (collectively, "the cleaning blade 4") that remove the residual toner remained after the primary transfer, and charging units 6*a*, 6*b*, 6*c*, and 6*d* (collectively, "the charging unit 6") in contact with the photoconductor 2. Horizontal conveyor screws 40*a*, 40*b*, 40*c*, and 40*d* (collectively, "the horizontal conveyor screw 40") horizontally conveys the waste toner removed by the cleaning blade 4, conveyor belts 8*a*, 8*b*, 8*c*, and 8*d* (collectively, "the conveyor belt 8") receives the waste toner from the horizontal conveyor screw 40 and conveys the toner upward, and waste-toner housing units 14*a*, 14*b*, 14*c*, and 14*d* (collectively, "the waste-toner housing unit 14") houses the waste toner received from the conveyor belt 8. Those units integrally form the image forming units 50*a*, 50*b*, 50*c*, and 50*d* (collectively, "the image forming unit 50"). The developing unit 3 can be included inside the housing of the image forming unit 50. The image forming apparatus 100 also includes an intermediate transfer unit. The intermediate transfer unit includes a driving roller 23, a driven roller 27, primary transfer rollers 29*a*, 29*b*, 29*c*, and 29*d* (collectively, "a primary transfer roller 29), and an intermediate transfer belt 101 that is extended over and rotated around the driving roller 23, the driven roller 27 and the primary transfer roller 29. Laser beams 102*a*, 102*b*, 102*c*, and 102*d* (collectively, "a laser beam 102") expose the photoconductor 2.

A bias supply (not shown) applies a bias voltage with a negative potential overlapped an alternating current (AC) with a direct current (DC) to a cored bar of a developing roller 32 of the developing unit 3. Another bias supply applies a bias voltage with a DC negative potential to the charging unit 6. The photoconductor 2 that works with the developing unit 3, the cleaning blade 4 in contact with the photoconductor 2, and the charging unit 6 constitute the image forming unit 50. The image forming apparatus 100 includes the four image forming units 50*a* to 50*d*, those functioning as a first image forming unit, a second image forming unit, a third image forming unit, and a fourth image forming unit, respectively.

In the image forming unit 50*a*, the cleaning blade 4*a* removes the residual toner on a surface of the photoconductor 2*a*. The charging unit 6*a* charges the surface of the photoconductor 2*a* to a uniform high potential to reset the photoconductor 2*a*. After that, the photoconductor 2*a* is irradiated with the laser beam 102*b*. In the image forming unit 50*b*, the photoconductor 2*b* is exposed to the laser beam 102*b*. The surface of the photoconductor 2*a* that is charged to the uniform high potential is selectively exposed based on image data, and a potential of the exposed part in the surface is attenuated. As a result, a latent image made of the low potential part and the high potential part, i.e., the initial potential is formed on the surface of the photoconductor 2*a*. This series of the operations are repeated in the image forming units 50*b*, 50*c*, and 50*d*. The developing unit 3*a* forms (develops) a first toner image by applying the toner to the low potential part (or the high potential part) of the latent image. The photoconductor 2*a* rotates to convey the first toner image, and transfers the first toner image to the intermediate transfer belt 101.

The image forming unit 50*b* operates in a similar manner as above in conformity with the timing at which the first toner image reaches a part in contact with the photoconductor 2*b*. Specifically, the developing unit 3*b* forms (develops) a second toner image on the photoconductor 2*b*. The photoconductor 2*b* rotates to convey the second toner image and transfers the second transfer image to the intermediate transfer belt 101 at the timing when the first toner image is conveyed to a part contacting the photoconductor 2*b*, so that the second toner image is overlapped on the first toner image. This series of the operations are repeated in the image forming units 50*c* and 50*d*.

The resultant quadruplex toner image is conveyed, and transferred to a sheet (not shown) by a secondary transfer roller 109.

According to the embodiment, because the recesses are arranged at each side of the conveyor belt, the conveyor belt can be formed by cost-effective resin molding. In addition, the conveyor belt receives the driving force at two portions, which makes it possible to rotate the conveyor belt in a balanced state and reduce occurrence of inclination of the conveyor belt.

Moreover, the deformable waste-toner housing unit allows a space for the new toner to gradually decreases, contrary to a space for the waste toner.

Furthermore, it is possible to form the conveyor belt with the simplest two-axis structure, that is, the conveyor belt can be supported only by one driving shaft and one supporting shaft.

According to an aspect of the present invention, it is possible to return an inclined conveyor belt to a balanced state or prevent the conveyor belt from being inclined. In other words, it is possible to facilitate stable running of the conveyor belt with a simple mechanism.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conveyor device for conveying toner of an electrophotographic imaging apparatus comprising:

a drive shaft:

a roller: and a belt that extends around the driving shaft and the roller supporting the belt, and comprises a plurality of partitions allowing the belt to effectively convey the toner and a plurality of recesses arranged at both sides of the belt in a width direction, wherein the driving shaft has only one projection corresponding to the recesses on one side of the belt in the width direction and another projection corresponding to the recesses on the other side of the belt in the width direction such that the driving shaft applies a driving force to the belt at least two different portions in a width direction of the belt to drive the belt.

2. The conveyor device according to claim 1, wherein the belt includes other recesses at a center of the belt in the width direction and the driving shaft has another projection corresponding to the recesses at the center of the belt.

3. The conveyor device according to claim 1, wherein the recesses penetrate the belt.

4. The conveyor device according to claim 1, wherein the portions are displaced in a length direction of the belt.

5. The conveyor device according to claim 1, wherein the portions are aligned in a length direction of the belt.

6. The conveyor device according to claim 1, wherein a portion of the projections in contact with the belt is chamfered.

7. The conveyor device according to claim 1, further comprising an outer wall inside of which the belt is located, wherein the waste toner is held between the partition and the outer wall and conveyed.

8. The conveyor device according to claim 1, further comprising a deformable housing unit for housing the waste toner conveyed by the belt.

9. The conveyor device according to claim 1, wherein a conveying path of the belt is arranged at an angle in a range from 0 degree to 90 degrees.

10. A cartridge that is configured to be attached to and detached from an image forming apparatus, the cartridge comprising:

a photoconductor on which a latent image is formed;

a cleaning unit that removes a toner on the photoconductor, and is integral with the photoconductor; and the conveyor device according to claim 1.

11. An image forming apparatus comprising:

a photoconductor on which a latent image is formed;

a cleaning unit that removes a toner on the photoconductor; and the cartridge according to claim 10.

12. An image forming method comprising:

developing a toner image from a latent image on a photoconductor;

transferring the toner image to a recording sheet;

cleaning a residual toner remaining on the photoconductor after the transferring; and housing the residual toner by using the cartridge according to claim 10.

13. An image forming apparatus comprising:

a photoconductor on which a latent image is formed;

a cleaning unit that removes a toner on the photoconductor; and the conveyor device according to claim 1.

14. An image forming method comprising:

developing a toner image from a latent image on a photoconductor;

transferring the toner image to a recording sheet;

cleaning a residual toner remaining on the photoconductor after the transferring; and housing the residual toner by using the conveyor device according to claim 1.

* * * * *